US011192363B2

(12) United States Patent
Ishida et al.

(10) Patent No.: US 11,192,363 B2
(45) Date of Patent: Dec. 7, 2021

(54) LIQUID EJECTION HEAD, LIQUID EJECTION APPARATUS, AND PRINTING APPARATUS

(71) Applicant: CANON KABUSHIKI KAISHA, Tokyo (JP)

(72) Inventors: Koichi Ishida, Tokyo (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 16/855,355

(22) Filed: Apr. 22, 2020

(65) Prior Publication Data

US 2020/0338889 A1 Oct. 29, 2020

(30) Foreign Application Priority Data

Apr. 26, 2019 (JP) ..... JP2019-085490

(51) Int. Cl.
*B41J 2/14* (2006.01)

(52) U.S. Cl.
CPC ..... *B41J 2/14145* (2013.01)

(58) Field of Classification Search
CPC .. B41J 2/1404; B41J 2/14145; B41J 2/14153; B41J 2/155; B41J 2/18; B41J 2202/12; B41J 2202/20
USPC ..... 347/20, 54, 56, 63, 65
See application file for complete search history.

(56) References Cited

U.S. PATENT DOCUMENTS 8,083,322 B2 * 12/2011 Tomizawa ..... B41J 2/1433 347/56
8,721,047 B2 * 5/2014 Sakurai ..... B41J 2/04501 347/50
9,931,845 B2 4/2018 Moriya et al.
10,022,979 B2 7/2018 Okushima et al.
10,179,453 B2 1/2019 Okushima et al.
10,214,014 B2 2/2019 Komamiya et al.
10,293,604 B2 5/2019 Aoki et al.
(Continued)

FOREIGN PATENT DOCUMENTS

JP 2017-124619 A 7/2017
JP 2017-144689 A 8/2017

OTHER PUBLICATIONS

Extended European Search Report dated Sep. 22, 2020, in European Patent Application No. 20169793.5.

*Primary Examiner* — An H Do
(74) *Attorney, Agent, or Firm* — Venable LLP

(57) ABSTRACT

An element substrate of a liquid ejection head includes an ejection opening array in which multiple ejection openings are arranged along a predetermined direction, pressure chambers communicating with the ejection openings, and heat generating elements for ejecting liquid, supplied to the pressure chambers, through the ejection openings. The element substrate also includes a predetermined supply path extending in the predetermined direction and communicating with the pressure chambers, a predetermined collection path communicating with the pressure chambers, multiple liquid supply ports communicating with the supply path at different positions in the predetermined direction, and a liquid collection port communicating with the collection path. Among the multiple liquid supply ports, at least a liquid supply port located at an end portion in the predetermined direction has an opening area larger than the opening area of the liquid collection port.

16 Claims, 10 Drawing Sheets

(56) References Cited

U.S. PATENT DOCUMENTS

| | | | |
|---|---|---|---|
| 2016/0059555 | A1 | 3/2016 | Tamura et al. |
| 2017/0197435 | A1 | 7/2017 | Yamamoto et al. |
| 2017/0197439 | A1 | 7/2017 | Okushima et al. |
| 2019/0001671 | A1 | 1/2019 | Yamada et al. |

* cited by examiner

LIQUID EJECTION HEAD, LIQUID EJECTION APPARATUS, AND PRINTING APPARATUS

BACKGROUND OF THE INVENTION

Field of the Invention

The present disclosure relates to liquid ejection head that ejects liquid, liquid ejection apparatus, and a printing apparatus.

Description of the Related Art

In a liquid ejection head mounted on an inkjet printing apparatus, solvent components of liquid evaporate from multiple ejection openings through which liquid is ejected, and this thickens the liquid inside the liquid ejection head in some cases. The thickening of the liquid changes the liquid ejection speed, and this can cause a decrease in droplet landing accuracy and dot formation errors. One of known measures against the thickening of liquid as above is making liquid flow within the liquid ejection head so that the liquid inside the pressure chambers, provided to be associated with the respective ejection openings, is forced to flow. In this method, unfortunately, variation occurs in the temperature of the liquid flowing within the liquid ejection head, causing variation in the ejection speed and amount of liquid ejected through the ejection openings, and this can affect the image quality.

As an alternative method, Japanese Patent Laid-Open No. 2017-124619 discloses a liquid ejection head that includes supply flow paths for supplying liquid and collection flow paths for collecting part of the liquid in the pressure chambers and that also includes one or more communicating ports (supply ports) for supplying liquid to the supply flow paths and one or more communicating ports (collection ports) for collecting liquid from the collection flow paths in which at least one of the number of supply ports and the number of collection ports is plural. This document discloses a configuration in which the supply ports are arranged at both end portions of ejection opening arrays in order to reduce temperature increase at the end portions of the ejection opening arrays that is caused when high-temperature liquid from the collection flow path side flows into the ejection opening arrays in the case where a large amount of liquid is ejected through a large number of the ejection openings. This configuration, depending on the condition of the temperature of the liquid flowing in from the collection side, can reduce the temperature increase at the end portions of the ejection opening arrays, and thus can alleviate the variation in ejection characteristics resulting from the variation in the temperature distribution of the ejection opening arrays.

SUMMARY OF THE INVENTION

A liquid ejection head in the present disclosure includes an element substrate including an ejection opening array in which multiple ejection openings through which liquid can be ejected are arranged along a first direction, multiple pressure chambers communicating with the respective ejection openings, heat generating elements capable of generating thermal energy for ejecting liquid supplied to the pressure chambers through the ejection openings, a first supply path extending in the first direction and communicating with the pressure chambers, a first collection path extending in the first direction and communicating with the pressure chambers, multiple liquid supply ports communicating with the first supply path at different positions along the first direction, and a liquid collection port communicating with the first collection path, and at least a liquid supply port of the liquid supply ports located at an end portion in the first direction has an opening area larger than the opening area of the liquid collection port.

Further features of the present invention will become apparent from the following description of exemplary embodiments with reference to the attached drawings.

DESCRIPTION OF THE EMBODIMENTS

The following describes an embodiment of the present disclosure with reference to the drawings. Note that in the present specification and the drawings, constituents having the same function are denoted by the same reference symbol.

<Configuration Example of Liquid Ejection Head>

Figure 1A:
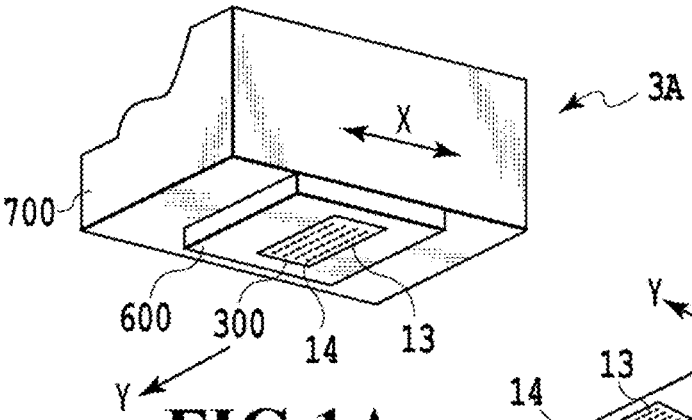
FIGS. 1A to 1E are perspective view diagrams illustrating configuration examples of liquid ejection heads to which a liquid ejection head of the present disclosure is applicable.

FIGS. 1A to 1E are perspective views of five kinds of liquid ejection heads 3A to 3E to which a liquid ejection head of the present disclosure is applicable. A liquid ejection head 3A illustrated in FIG. 1A is a liquid ejection head applied to a serial-scan printing apparatus which will described later with reference to FIG. 2A. A serial-scan printing apparatus is a printing apparatus that prints an image on a not-illustrated print medium by repeating a printing scan for ejecting liquid through ejection openings 13 while moving a liquid ejection head 3 in the main scanning direction (X direction) and an operation for conveying the print medium in the sub scanning direction (Y direction).

The liquid ejection head 3A includes a liquid ejection unit 300, a flow-path unit 600 that has flow paths for supplying liquid to the liquid ejection unit 300, and a holding member 700 for holding the flow-path unit 600. The liquid ejection head 3A has multiple ejection opening arrays 14 in each of which multiple ejection openings 13 are arranged in one direction. Here, the arrangement direction of the ejection openings 13 is determined to intersect (be orthogonal to, in FIG. 1A) the main scanning direction (X direction) of the liquid ejection head 3A in the printing apparatus. Note that the sub scanning direction (Y direction) intersects the main scanning direction (X direction), and in FIG. 1A, the sub scanning direction is orthogonal to the main scanning direction.

Figure 1B:
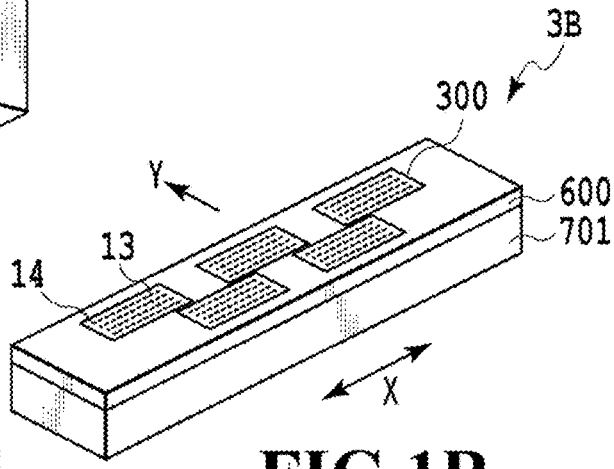

A liquid ejection head 3B illustrated in FIG. 1B has liquid ejection units 300 arranged in a staggered manner along the X direction, each liquid ejection unit 300 having multiple ejection openings 13 arranged along the X direction, and thus, the liquid ejection head 3B is a long length of a line head. The liquid ejection head 3B includes the multiple liquid ejection units 300, a flow-path unit 600 for supplying liquid to the multiple liquid ejection units 300, and a holding member 800 holding the flow-path unit 600. The liquid ejection head 3B is used for a full-line printing apparatus (liquid ejection apparatus) described later. A full-line printing apparatus is a printing apparatus that performs printing by ejecting liquid through the liquid ejection head 3 fixed at a specified position in the printing apparatus while continuously conveying a print medium in a direction intersecting (in FIG. 1B, a direction (Y direction) orthogonal to) the direction in which the ejection opening arrays 14 extend.

Figure 1C:
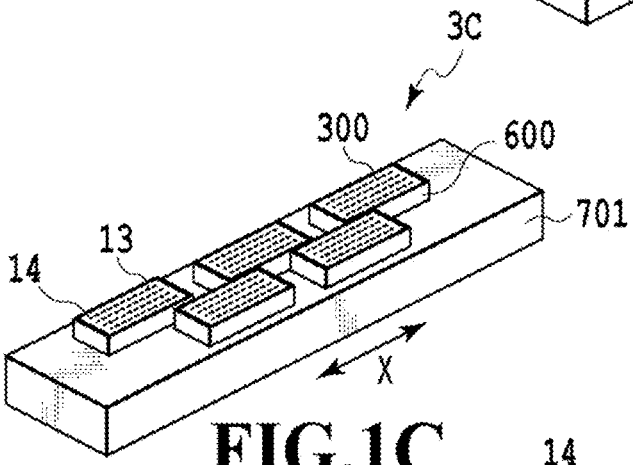

A liquid ejection head 3C illustrated in FIG. 1C is a long length of a line head having multiple liquid ejection units 300 arranged in a staggered manner as with the liquid ejection head 3B illustrated in FIG. 1B, and the liquid ejection head 3C is for being mounted on a full-line printing apparatus. Here, the liquid ejection head 3C is different from the liquid ejection head 3B illustrated in FIG. 1B in that a flow-path unit 600 is provided for each individual liquid ejection unit 300.

Figure 1D:
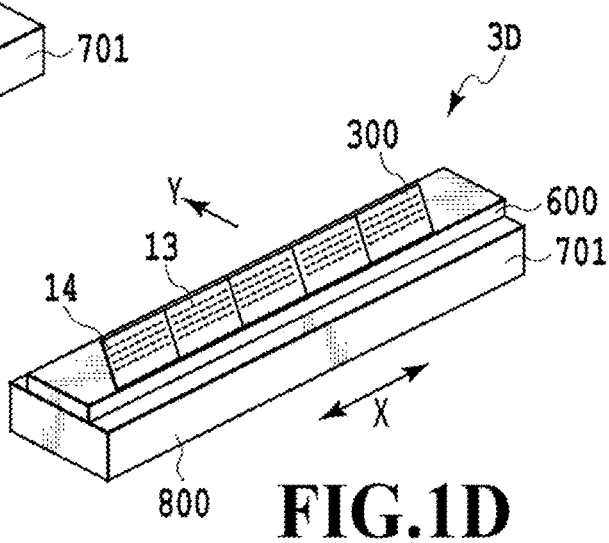

A liquid ejection head 3D illustrated in FIG. 1D is a long length of a line head having multiple liquid ejection units 300 sequentially arranged. In the liquid ejection head 3D, the liquid ejection units 300 are arranged such that an end portion of a liquid ejection unit 300 is close to and faces an end portion of an adjoining liquid ejection unit 300. Such arrangement in which the liquid ejection units 300 are arranged approximately in a line such that adjoining liquid ejection units 300 are at least partially overlapped with each other in a direction (Y direction) orthogonal to the arrangement direction of the ejection openings (X direction) is called in-line arrangement. This liquid ejection head 3D also includes a common flow-path unit 600 for supplying liquid to the multiple liquid ejection units 300 and a holding member 800 holding the flow-path unit 600. This liquid ejection head 3D is also for being mounted on a full-line printing apparatus.

Figure 1E:
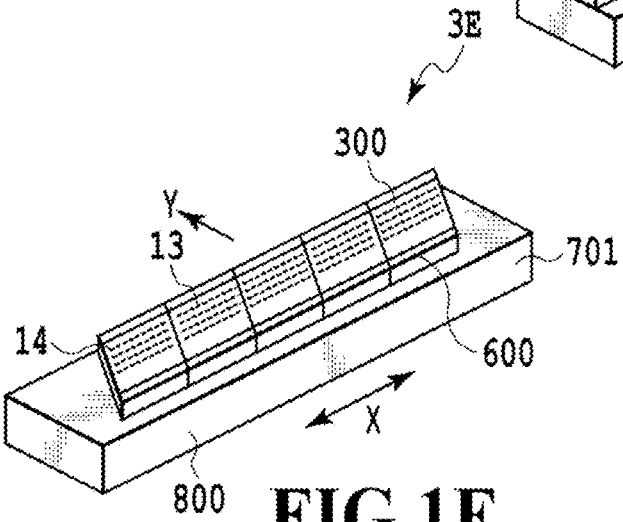

A liquid ejection head 3E illustrated in FIG. 1E is a long length of a line head having multiple liquid ejection units 300 in in-line arrangement as with the liquid ejection head 3D illustrated in FIG. 1D. This liquid ejection head 3 has flow-path units 600 provided to be associated with the respective liquid ejection units 300, and this is the different point from the liquid ejection head 3D illustrated in FIG. 1D. Note that the liquid ejection units 300 are held by the holding member 800.

As illustrated in FIGS. 1D and 1E, a line head having liquid ejection units 300 in in-line arrangement has an advantage that the length in the Y direction can be shorter than that of a line head having liquid ejection units 300 arranged in a staggered manner as illustrated in FIGS. 1B and 1C. The technique in the present disclosure is effective especially in the case where it is applied to a long length of a liquid ejection head, in in-line arrangement as illustrated in FIGS. 1D and 1E. However, the technique in the present disclosure is not limited to liquid ejection heads in in-line arrangement but effectively applicable to the liquid ejection heads illustrated in FIGS. 1A to 1C. In addition, the positions and number of liquid ejection units 300 are not limited to those in the example illustrated in FIGS. 1A to 1E.

As has been described above, the liquid ejection heads 3A to 3E illustrated in FIGS. 1A to 1E have a common point that all of them have liquid ejection units 300 and flow-path units 600 even though the overall shapes and configurations are different. In particular, in terms of the liquid ejection unit 300, all of the liquid ejection heads have a characteristic configuration of the technique in the present disclosure in the same or a similar manner. Hence, the liquid ejection heads 3A to 3E are capable of reducing the variation in the speed and amount of liquid ejected through the ejection openings. Note that in the following description, the liquid ejection heads 3A to 3E in the present embodiment are collectively referred to as the liquid ejection head 3 in some cases.

<Liquid Ejection Apparatus>

Figure 2A:
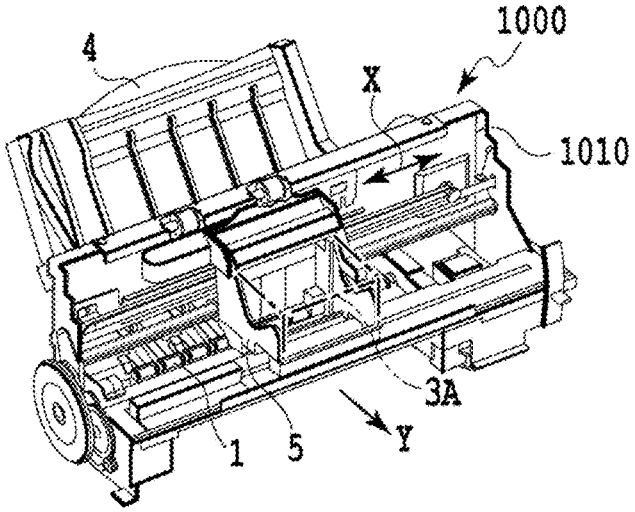
FIGS. 2A to 2C are diagrams illustrating liquid ejection apparatuses to which the liquid ejection head of the present disclosure is applicable and a liquid supply system for the liquid ejection apparatuses.
Figure 2B:
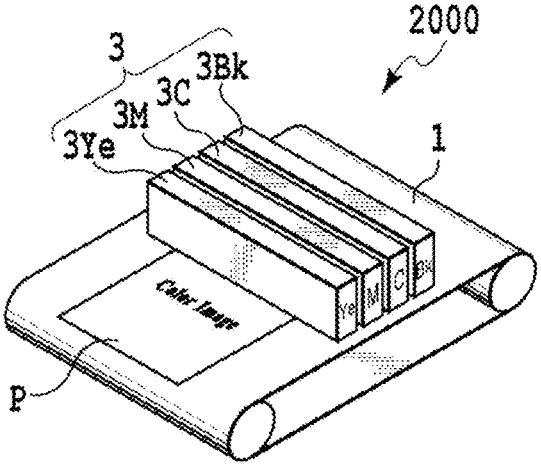

FIGS. 2A and 2B are diagrams illustrating liquid ejection apparatuses to which the liquid ejection head of the present disclosure is applicable. A printing apparatus 1000 illustrated in FIG. 2A is, for example, a serial-scan printing apparatus (liquid ejection apparatus) that performs printing with the liquid ejection head 3A illustrated in FIG. 1A. This printing apparatus 1000 includes a chassis 1010, a conveyance unit 1, the foregoing liquid ejection head 3A, a feeding unit 4, and a carriage 5. The chassis 1010 is constituted of multiple plate-shaped metal members having specified rigidities and forms a skeletal frame of this printing apparatus. The feeding unit 4 feeds not-illustrated sheet-shaped print media into the printing apparatus. The conveyance unit 1 conveys print media fed from the feeding unit 4, in the sub scanning direction (Y direction). The carriage 5 on which the liquid ejection head 3A is mounted is movable back and forth in the main scanning direction (X direction).

The feeding unit 4, the conveyance unit 1, and the carriage 5 are assembled to the chassis 1010. This printing apparatus 1000 repeats a printing scan for ejecting liquid through the ejection openings 13 of the liquid ejection head 3 while moving the liquid ejection head 3A together with the carriage 5 in the main scanning direction (X direction) and a conveyance operation for conveying a print medium in the sub scanning direction (Y direction). Through these operations, an image is printed on the print medium. The liquid ejection head 3 is supplied with liquid from a not-illustrated liquid supply unit.

A printing apparatus 2000 in FIG. 2B is a full-line printing apparatus (liquid ejection apparatus) that performs printing with long lengths of liquid ejection heads such as 3B to 3E as illustrated in FIGS. 1B to 1E. This printing apparatus 2000 includes a conveyance unit 1 that continuously conveys a sheet-shaped print medium S. The conveyance unit 1 may have a configuration including a conveyance belt as illustrated in FIG. 2B or a configuration including conveying rollers. The printing apparatus 2000 illustrated in FIG. 2B has four liquid ejection heads 3Ye, 3M, 3C, and 3Bk for ejecting yellow (Ye) ink, magenta (M) ink, cyan (C) ink, and black (Bk) ink, respectively. The four liquid ejection heads 3Ye, 3M, 3C, and 3Bk are supplied with liquids in respective colors. While the print medium 2 is being conveyed continuously, liquids are ejected from the liquid ejection heads 3 fixed at specified positions in the printing apparatus.

Ejected liquids are landed on the print medium 2, and thus, a color image can be continuously printed on the print medium S.

Figure 2C:
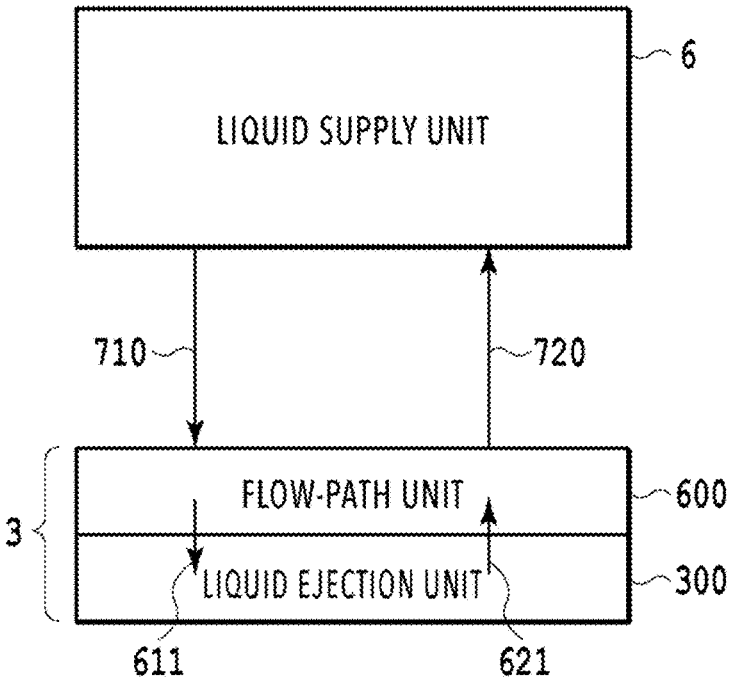

FIG. 2C is a diagram for explaining a supply system for supplying liquid to a liquid ejection head 3. A liquid supply unit 6 is connected to the liquid ejection head 3 via a circulation flow path 710 on the supply side and a circulation flow path 720 on the collection side. The liquid supply unit 6 supplies liquid to the liquid ejection head 3 via the circulation flow path 710 on the supply side. Part of the liquid supplied to the liquid ejection head 3 is collected via the circulation flow path 720 on the collection side. The liquid ejection head 3 has a flow-path unit 600 and a liquid ejection unit 300. The flow-path unit 600 supplies liquid to the liquid ejection unit 300 via a supply flow path 611 which is part of the flow-path unit 600. Part of the liquid supplied to the liquid ejection unit 300 is ejected toward a print medium through ejection openings provided in the liquid ejection unit 300, and thereby an image is printed. The remaining liquid that was not ejected through the ejection openings is collected into the flow-path unit 600 via a collection flow path 612, and then collected into the liquid supply unit 6 via the circulation flow path 720. Note that the liquid ejection head 3 includes a liquid-flow generation apparatus (not illustrated) that generates liquid flow in a direction from the supply flow path 611 through pressure chambers 23 toward the collection flow path 612.

The foregoing configurations of the printing apparatuses are examples and are not intended to limit the scope of the present disclosure. For example, a configuration may be employed in which liquid is not collected from the liquid ejection head 3 to the liquid supply unit 6. In this case, the liquid ejection head 3 may have a sub-tank for temporarily storing liquid supplied from the liquid supply unit 6. In this configuration, when liquid is ejected toward a print medium 2, and the liquid in the liquid ejection head 3 is reduced, liquid is added from the liquid supply unit 6 to the sub-tank, and the liquid is supplied from the sub-tank to the liquid ejection head.

<Constituent Members of Liquid Ejection Unit 300>

Figure 3:
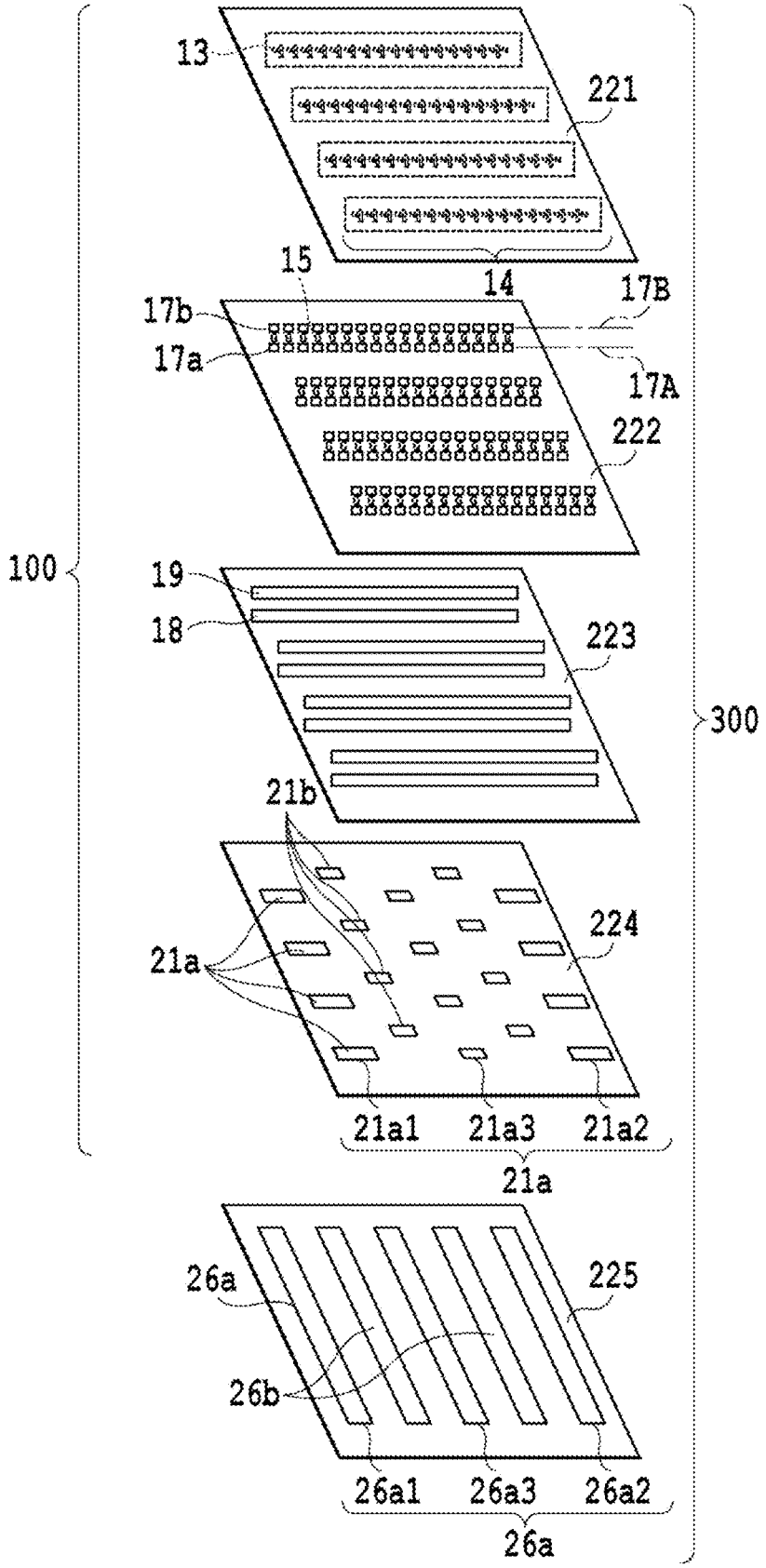
FIG. 3 is an exploded plan view diagram illustrating the configuration of a liquid ejection unit provided in the liquid ejection head.

FIG. 3 is an exploded plan view diagram illustrating the configuration of a liquid ejection unit 300 provided in a liquid ejection head 3 in the present embodiment. The liquid ejection unit 300 includes a print element substrate 100 and a support member 225 which is joined to the print element substrate 100. The print element substrate 100 has an ejection-opening forming member 221, an element forming member 222, a liquid supply-path member 223, and a lid member 224 which are sequentially joined to one another.

The ejection-opening forming member 221 has multiple ejection openings 13 for ejecting liquid, lined along the X direction. These lined multiple ejection openings constitute an ejection opening array 14. In the present embodiment, one ejection-opening forming member 221 has multiple ejection opening arrays 14 (four ejection opening arrays in FIG. 3) arranged in parallel with one another.

The element forming member 222 has multiple heat generating elements 15 arranged at positions facing the respective ejection openings 13, multiple individual supply paths 17*a* for supplying liquid to the respective heat generating elements 15, and multiple individual collection paths 17*b* for collecting part of the supplied liquid. The individual supply paths 17*a* and the individual collection paths 17*b* pass through the element forming member 222. The heat generating element 15 is an electrothermal conversion element capable of generating thermal energy for ejecting liquid through the ejection opening 13 that the heat generating element 15 faces. In the present embodiment, each heat generating element 15 is associated with one individual supply path 17*a* and one individual collection path 17*b*. Thus, in the element forming member 222, the multiple individual supply paths 17*a* and the multiple individual collection paths 17*b* are arranged along the X direction, corresponding to the respective ejection opening arrays 14. In the following description, multiple individual supply paths 17*a* associated with the same ejection opening array 14 are called a group of individual supply paths 17A; multiple individual collection paths 17*b* associated with the same ejection opening array 14 are called a group of individual collection paths 17B. In FIG. 3, four groups of individual supply paths 17A and four groups of individual collection paths 17B are formed to be respectively associated with four ejection opening arrays.

The liquid supply-path member 223 has multiple liquid supply paths 18 communicating with multiple groups of individual supply paths 17A and multiple liquid collection paths 19, each having a rectangular opening shape, communicating with multiple groups of individual collection paths 17B. In FIG. 3, the liquid supply-path member 223 has four liquid supply paths 18 corresponding to the groups of individual supply paths 17A and four liquid collection paths 19 corresponding to the groups of individual collection paths 17B. Note that both sets of the liquid supply paths 18 and the liquid collection paths 19 are through paths that pass through the liquid supply-path member 223.

The lid member 224 has liquid supply ports 21*a* communicating with the liquid supply paths 18 and liquid collection ports 21*b* communicating with the liquid collection paths 19. Both sets of the liquid supply ports 21*a* and the liquid collection ports 21*b* are through holes that pass through the lid member 224. In the lid member 224 of the present embodiment, multiple liquid supply ports 21*a* (three liquid supply ports 21*a*1, 21*a*2, and 21*a*3 in FIG. 3) are formed to communicate with each liquid supply path 18 at different positions along the X direction (first direction). Further, in the lid member 224, multiple (two in the figure) liquid collection ports 21*b* are formed to communicate with each liquid collection path 19 at different positions along the X direction.

Of the multiple liquid supply ports 21*a*1 to 21*a*3, the liquid supply ports located at both end portions in the X direction, in other words, the liquid supply ports 21*a*1 and 21*a*2 located closest to the end portions in the X direction of the lid member, have opening areas larger than those of the liquid supply port 21*a*3 and the liquid collection ports 21*b*. Note that the other liquid supply port 21*a*3 has approximately the same opening area as those of the two liquid collection ports 21*b*.

The support member 225 has multiple (three in FIG. 3) communicating supply ports 26*a* (26*a*1, 26*a*2, 26*a*3) and multiple (two in FIG. 3) communicating collection ports 26*b*. Each of the communicating supply ports 26*a* (26*a*1, 26*a*2, 26*a*3) and the communicating collection ports 26*b* is a through hole extending in a direction intersecting the X direction in which the ejection openings 13 are arranged. Of the communicating supply ports 26*a* (26*a*1, 26*a*2, 26*a*3), the communicating supply port 26*a*1 located close to one end portion in the X direction of the support member 225 communicates with the multiple (four in FIG. 3) liquid supply ports 21*a*1. The communicating supply port 26*a*2 located close to the other end portion of the support member 225 communicates with the multiple (four in FIG. 3) liquid supply ports 21*a*2. The communicating supply port 26*a*3 located in the center of the support member 225 communicates with the multiple (four in FIG. 3) liquid supply ports 21*a*3. Each of the two communicating collection ports 26*b* communicates with four liquid collection ports 21*b*.

The support member 225 should preferably be made of a material that has a coefficient of thermal expansion close to that of the print element substrate 100 and that allows the communicating supply ports 26*a* and the communicating collection ports 26*b* to be formed with high accuracy. As an example, in the case where the print element substrate 100 is formed by processing a silicon wafer, the support member 225 should preferably be made of a material such as silicon, alumina, or glass.

Note that although in this example, the liquid ejection unit 300 has the print element substrate 100 and the support member 225, the configuration of the liquid ejection unit 300 is not limited to this example. The liquid ejection unit 300 may be configured to have only a print element substrate 100 without having a support member 225.

<Configuration of Print Element Substrate 100>

Figure 4:
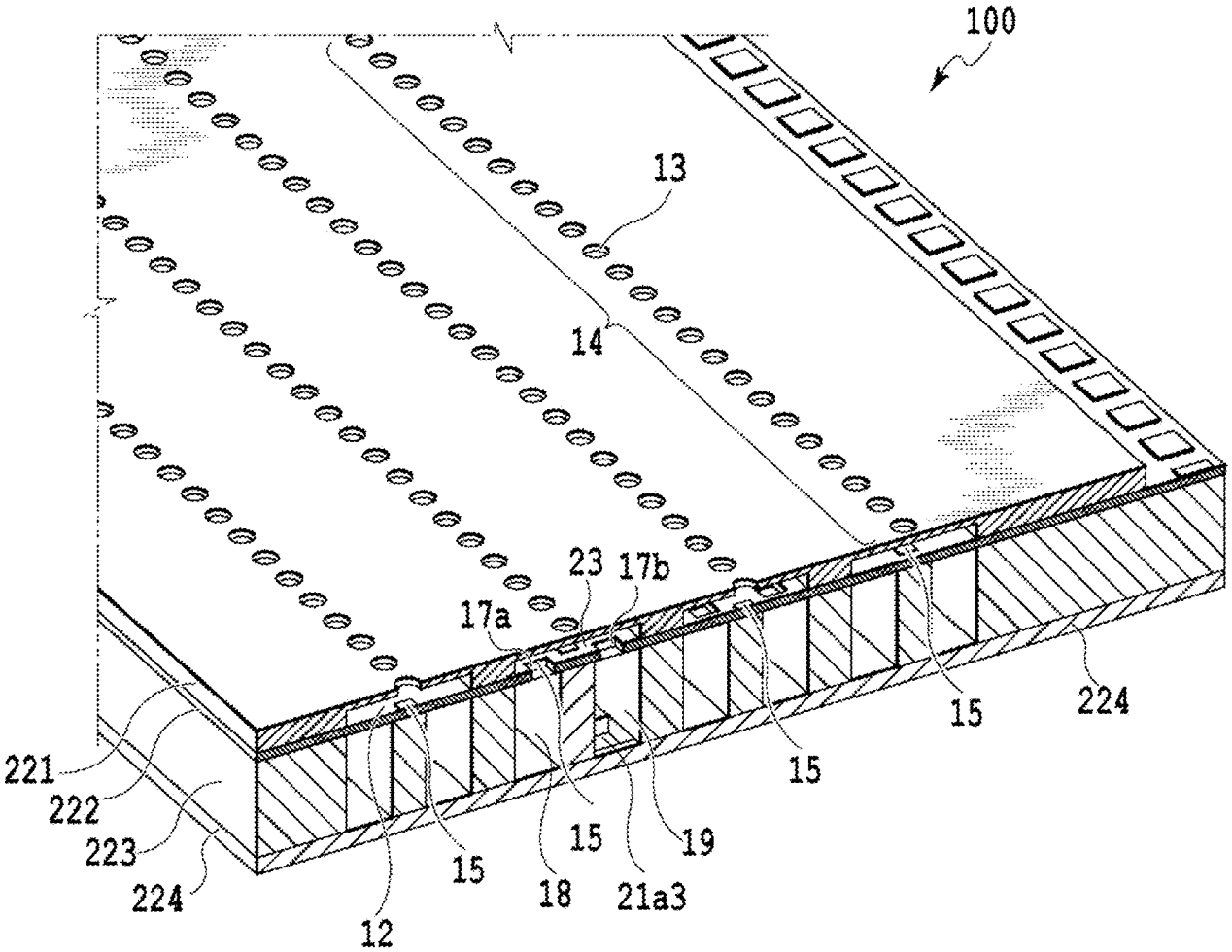
FIG. 4 is a cross-sectional perspective view of a print element substrate.

FIG. 4 is a cross-sectional perspective view of a print element substrate 100 constituted of the constituent members illustrated in the exploded plan view of FIG. 3. As illustrated in FIG. 4, one surface of the ejection-opening forming member 221 serves as one surface of the print element substrate 100 (the ejection opening surface). This ejection-opening forming member 221 has multiple ejection openings 13 arranged to pass through the member 221 in its thickness direction, and these ejection openings 13 constitute the ejection opening arrays 14. The ejection-opening forming member 221 has recesses 12 on the other surface, and these recesses 12 form spaces referred to as pressure chambers 23 between the ejection-opening forming member 221 and the element forming member 222. The pressure chambers 23 are associated with the respective multiple ejection openings 13. Each pressure chamber 23 has a heat generating element 15 at a position corresponding to each ejection opening 13.

As described earlier, each pressure chamber 23 communicates with an individual supply path 17*a* and an individual collection path 17*b* provided in the element forming member 222. Each individual supply path 17*a* communicates with a liquid supply path 18 provided in the liquid supply-path member 223. Each individual collection path 17*b* communicates with a liquid collection path 19 provided in the liquid supply-path member 223. The liquid supply path 18 communicates with liquid supply ports 21*a* (see FIG. 3); the liquid collection path 19 communicates with liquid collection ports 21*b* (see FIG. 3).

As has been described above, the print element substrate 100 has liquid-supply flow paths constituted of the liquid supply ports 21*a*, the liquid supply paths 18, and the individual supply paths 17*a* for guiding the liquid supplied from the communicating supply ports 26*a* of the support member 225 to the pressure chambers 23. The print element substrate 100 also has liquid-collection flow paths constituted of the individual collection paths 17*b*, the liquid collection paths 19, and the liquid collection ports 21*b* for guiding the liquid in the pressure chamber 23 to the communicating collection ports 26*b* of the support member 225.

When the liquid in the pressure chamber 23 is in a static state, in other words, when the liquid is not being ejected, the pressure of the pressure chamber 23 is kept to be a pressure (negative pressure) that forms a meniscus of the liquid near the opening of the ejection opening 13.

<Configuration of Flow-Path Unit 600>

Figure 5:
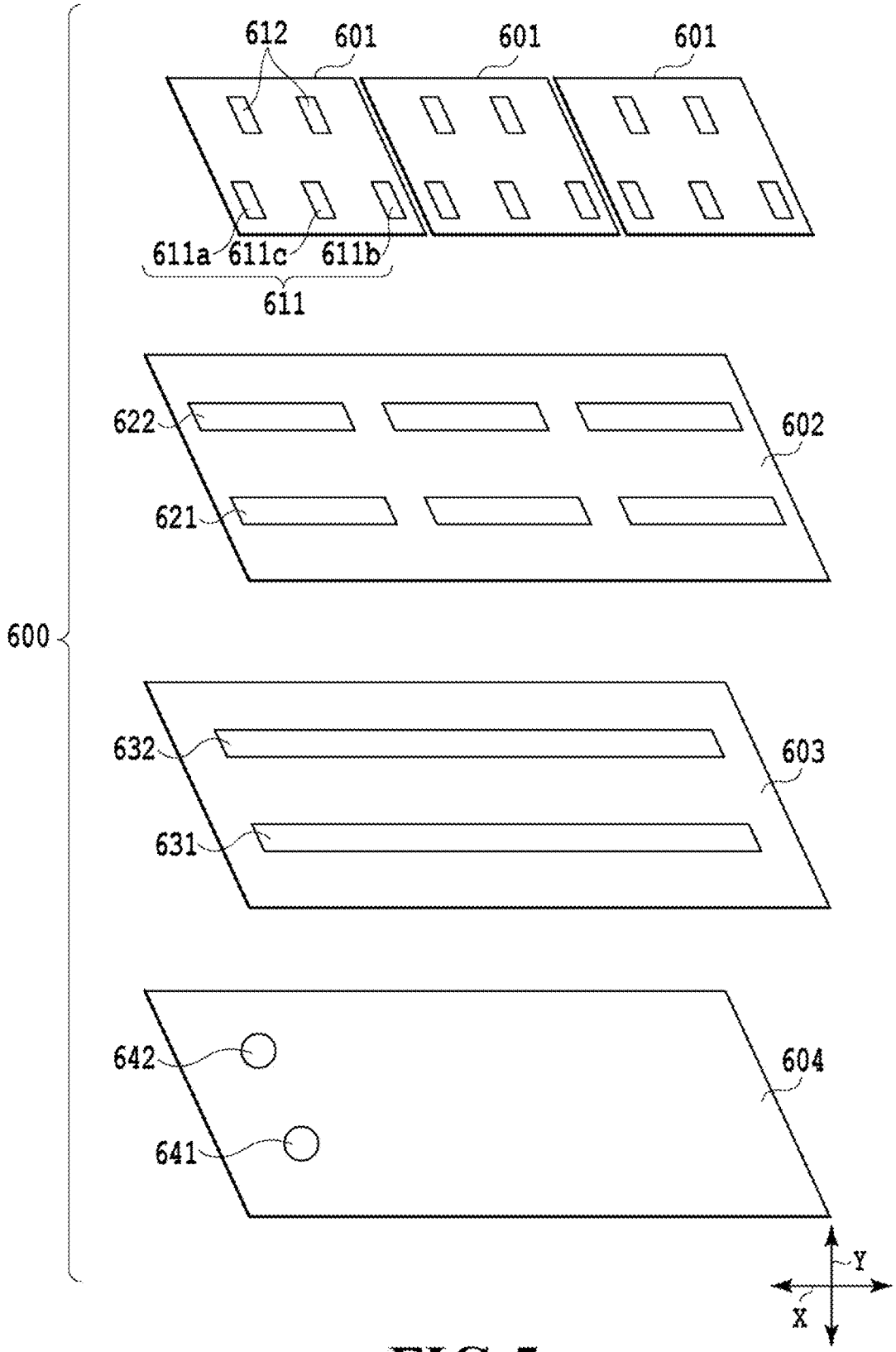
FIG. 5 is an exploded plan view diagram illustrating the configuration of a flow-path unit.

FIG. 5 is an exploded plan view of constituent members of a flow-path unit 600 according to the present embodiment, viewed from the side to which the foregoing liquid ejection units 300 are to be joined. The flow-path unit 600 illustrated here is configured to have three liquid ejection units 300 on it. The one flow-path unit 600 is configured to supply the liquid supplied from the liquid supply unit 6 (FIG. 2C) to three liquid ejection units 300.

The flow-path unit 600 is constituted of three first flow-path members 601, a second flow-path member 602, a third flow-path member 603, and a fourth flow-path member 604, which are joined together. Note that to each of the three first flow-path members 601 is to be joined one foregoing liquid ejection unit 300.

Each of the three first flow-path members 601 has multiple (three in FIG. 5) supply flow paths 611 (611*a*, 611*b*, 611*c*) and multiple (two in FIG. 5) collection flow paths 612. Both sets of the supply flow paths 611 and the collection flow paths 612 pass through the first flow-path member 601 in its thickness direction. To one surface (the upper surface in FIG. 5) of each first flow-path member 601 is joined the support member 225 of the foregoing liquid ejection unit 300. This enables the supply flow paths 611*a*, 611*b*, and 611*c* of the first flow-path member 601 to communicate respectively with the communicating supply ports 26*a*1, 26*a*2, and 26*a*3 provided in the support member 225. This also enables the two collection flow paths 612 of the first flow-path member 601 to communicate respectively with the two communicating collection ports 26*b* provided in the support member 225.

The second flow-path member 602 has multiple (three in FIG. 5) first common supply flow paths 621 extending in the X direction and multiple (three in FIG. 5) first common collection flow paths 622 extending in the X direction. Each flow path 621 or 622 passes through the second flow-path member 602 in its thickness direction. Each first common supply flow path 621 communicates with the multiple supply flow paths 611 (611*a*, 611*b*, 611*c*) of the corresponding first flow-path member 601; each first common collection flow path 622 communicates with the multiple (two in FIG. 5) collection flow paths 612 of the corresponding first flow-path member 601.

The third flow-path member 603 has one second common supply flow path 631 extending in the X direction and one second common collection flow path 632 extending in the X direction. The flow paths 631 and 632 pass through the third flow-path member 603 in its thickness direction. The second common supply flow path 631 communicates with the three first common supply flow paths 621 provided in the second flow-path member 602. The second collection flow path 632 communicates with the three first common collection flow paths 622 provided in the second flow-path member 602.

The fourth flow-path member 604 has one common supply hole 641 and one common collection hole 642. The common supply hole 641 communicates with the second common supply flow path 631; the common collection hole 642 communicates with the second common collection flow path 632. The common supply hole 641 is connected to the circulation flow path 710 on the supply side for connecting the foregoing liquid supply unit 6 (FIG. 2C) and the liquid ejection head 3; the common collection hole 642 is connected to the circulation flow path 720 on the collection side.

The first to fourth flow-path members 601 to 604 should preferably be made of a member composed of a material having corrosion resistance to the liquid and a low coefficient of linear expansion. Examples of materials usable for the first to fourth flow-path members 601 to 604 include composite materials (resin materials) in which inorganic fillers such as silica particles or fibers are added to the base material. Examples of usable materials for the base material include alumina, liquid crystal polymer (LCP), polyphenyl sulfide (PPS), and polysulfone (PSF). The flow-path unit 600 may be formed by stacking the flow-path members 601 to 604 and bonding them together. In the case where resin composite materials are used, the flow-path unit 600 may be formed by stacking the flow-path members and welding them together.

The second to fourth flow-path members 602 to 604 also have a function as a support member for securing the strength of the liquid ejection head 3. Hence, the second to fourth flow-path members 602 to 604 as a support member should preferably be made of a material having high mechanical strength. Specifically, the material should preferably be stainless steel (SUS), titanium (Ti), alumina, or the like.

The first flow-path members 601 are formed of heat resistant members. These first flow-path members 601 reduce the heat transfer from the liquid ejection units 300 to the second to fourth flow-path members 602 to 604 as a support member and also reduce the heat conduction between the liquid ejection units 300.

The material of the first flow-path member 601 should preferably be one having a low thermal conductivity and a coefficient of linear expansion that is not much different from those of the second to fourth flow-path members 602 to 604 of the flow-path unit 600 and the liquid ejection unit 300. Specifically, the first flow-path member 601 should preferably be formed of a composite material that has a resin material as a base material, in particular, polyphenyl sulfide (PPS) or polysulfone (PSF) and in which inorganic fillers such as silica fine particles are added to the base material. In a case where there is much difference between the linear expansion coefficient of the support member 225 of the liquid ejection unit 300 and that of the second flow-path member 602, when the temperature of the liquid ejection unit 300 increases due to heat at liquid ejection, there is a possibility of the liquid ejection unit 300 and the first flow-path member 601 being peeled off each other. In a similar manner, in a case where there is much difference between the linear expansion coefficient of the first flow-path member 601 and that of the second flow-path member 602, there is a possibility of the first flow-path member 601 and the second flow-path member 602 being peeled off each other.

For this reason, in the present embodiment, only one liquid ejection unit 300 is mounted on one first flow-path member 601 so that the size of each flow-path member 601 is small. However, in a case where the difference in the coefficient of linear expansion is small enough, the multiple flow-path members may be connected, and multiple liquid ejection units may be mounted on it.

In the present embodiment, a heat resistance R (K/W) of the first flow-path member 601 is determined to satisfy the relationship in formula 1 so that the temperature of the entire liquid ejection head will not increase due to the heat generated when the heat generating elements 15 are driven.

$$R \geq 1.4/\ln\{0.525e^{1.004P}-0.372\}^{-1} \quad \text{(formula 1)}$$

Here, P is the thermal energy (μJ/pL) that is inputted from the heat generating element 15 to liquid per unit volume to eject the liquid through the ejection opening.

Figure 6:
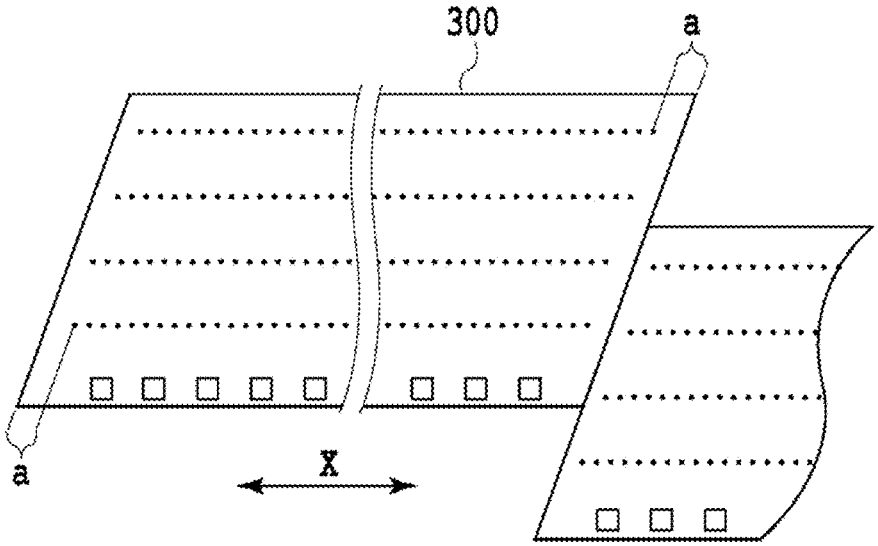
FIG. 6 is a plan view diagram schematically illustrating two print element substrates in an arrangement.

FIG. 6 is a diagram illustrating the configuration of an end portion of multiple liquid ejection units 300 arranged on first flow-path members 601 of a flow-path unit 600. As illustrated in FIG. 6, the liquid ejection unit 300 in the present embodiment has a parallelogram planar shape. These multiple parallelogram liquid ejection units 300 are disposed in in-line arrangement along the X direction, substantially forming long lengths of ejection opening arrays extending in the X direction. Since three liquid ejection units 300 are arranged on the first flow-path members 601 of the flow-path unit 600 illustrated in FIG. 5, it means that one flow-path unit 600 has ejection opening arrays three times as long as short lengths of ejection opening arrays formed in each liquid ejection unit 300. Arranging these multiple flow-path units 600 along the X direction makes it possible to form a full-line liquid ejection head having long lengths of ejection opening arrays.

In the liquid ejection head of the present embodiment having the above configuration, liquid flows from the liquid supply unit 6 via the circulation flow path 710 into the common supply hole 641 of the flow-path unit 600. The liquid that has flowed into the common supply hole 641 flows inside the second common supply flow path 631 and then flows into the multiple (three in FIG. 5) first common supply flow paths 621 with which the second common supply flow path 631 communicates. The liquid that has flowed into each of the multiple first common supply flow paths 621 flows via the supply flow paths 611 (611*a*, 611*b*, 611*c*) provided in each of the multiple first flow-path members 601 into the liquid ejection unit 300.

In the liquid ejection unit 300, the liquid supplied from the flow-path unit 600 first flows into multiple (three in FIG. 3) communicating supply ports 26*a* (26*a*1, 26*a*2, 26*a*3) provided in the support member 225. The liquid that has flowed into the multiple communicating supply ports 26*a*1, 26*a*2, and 26*a*3 flows into the liquid supply ports 21*a*1, 21*a*2, and 21*a*3 of the lid member 224, respectively, and then flows into the multiple (four in FIG. 3) liquid supply paths 18 formed in the liquid supply-path member 223. After that, the liquid that has flowed into the four liquid supply paths 18 flows via the individual supply paths 17*a* of the element forming member 222 into the pressure chambers 23 and is supplied to the pressure chambers 23 and the ejection openings 13.

The liquid that has flowed into the pressure chambers 23 then flows via the individual collection paths 17*b* communicating with the pressure chambers 23 into the liquid collection paths 19 provided in the liquid supply-path member 223 and then flows via the liquid collection ports 21*b* into the communicating collection ports 26*b*.

The liquid that has flowed into the communicating collection ports 26*b* then flows via the collection flow paths 612 provided in the first flow-path members 601 of the flow-path unit 600 into the first common collection flow paths 622 of the second flow-path member 602. The liquid that has flowed into the first common collection flow paths 622 flows via the second common collection flow path 632 provided in the third flow-path member 603 to the common collection hole 642, through which the liquid flows via the circulation flow path 720 on the collection side into the liquid supply unit 6. As described above, in the printing apparatus 2000 of the present embodiment, liquid circulates from the liquid supply unit 6 via the liquid ejection head 3 and back into the supply unit 6 again.

Figure 7:
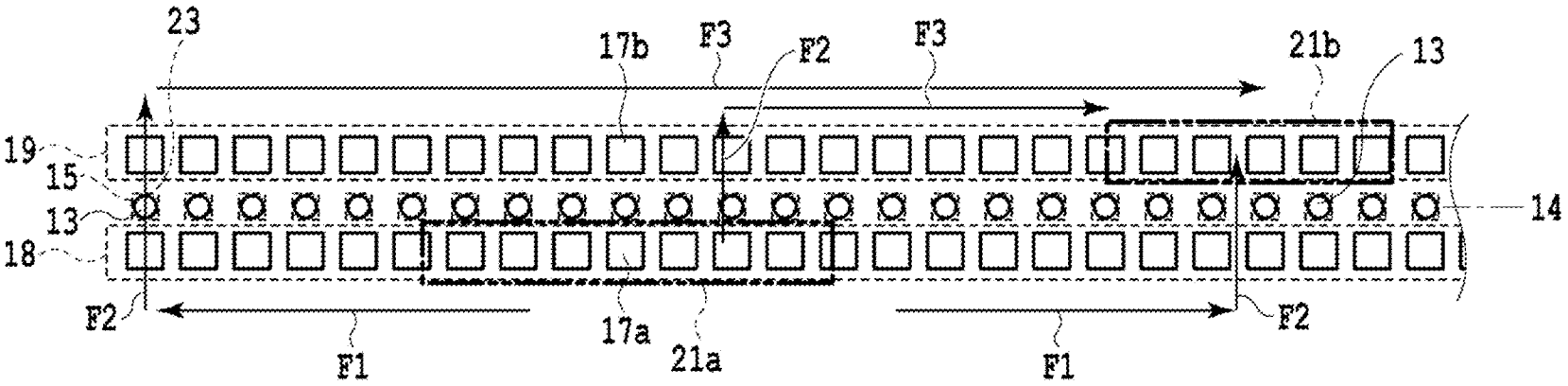
FIG. 7 is an explanatory diagram illustrating the flow of liquid in the print element substrate.

FIG. 7 is a plan view diagram schematically illustrating liquid flow inside the print element substrate 100 in the state where the liquid is not being ejected through the ejection openings 13. The liquid that has flowed from the flow-path unit 600 into the communicating supply ports 26*a* of the support member 225 of the liquid ejection unit 300, as described earlier, flows into the liquid supply ports 21*a* then into the liquid supply path 18, and then flows in the direction indicated by the arrows F1. The liquid that has flowed inside the liquid supply path 18 flows via the individual supply paths 17*a* into the pressure chambers 23. In the case where the heat generating elements 15 are not driven, the liquid that has flowed into the pressure chambers 23 flows into the individual collection paths 17*b* as indicated by the arrows F2. The liquid that has flowed into the individual collection paths 17*b* flows inside the liquid collection path 19 as indicated by the arrows F3. After that, the liquid flows into the liquid collection ports 21*b*, and flows out through the communicating collection ports 26*b* to the flow-path unit 600.

<Flow of Liquid in Ejection Opening Array>

Figure 8A:
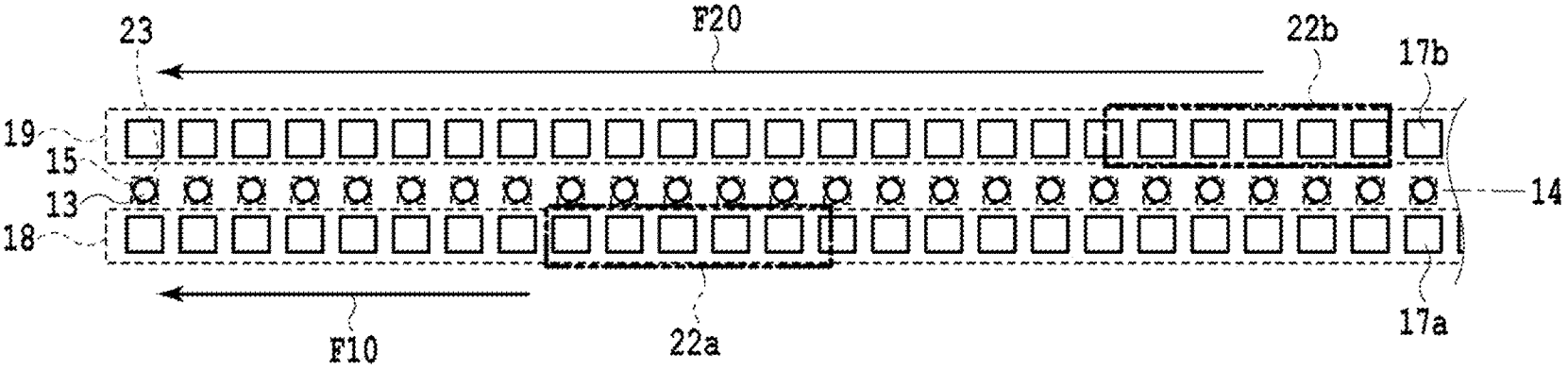
FIGS. 8A and 8B are diagrams illustrating the flow of liquid flowing in a liquid supply path and a liquid collection path when the liquid is being ejected.
Figure 8B:
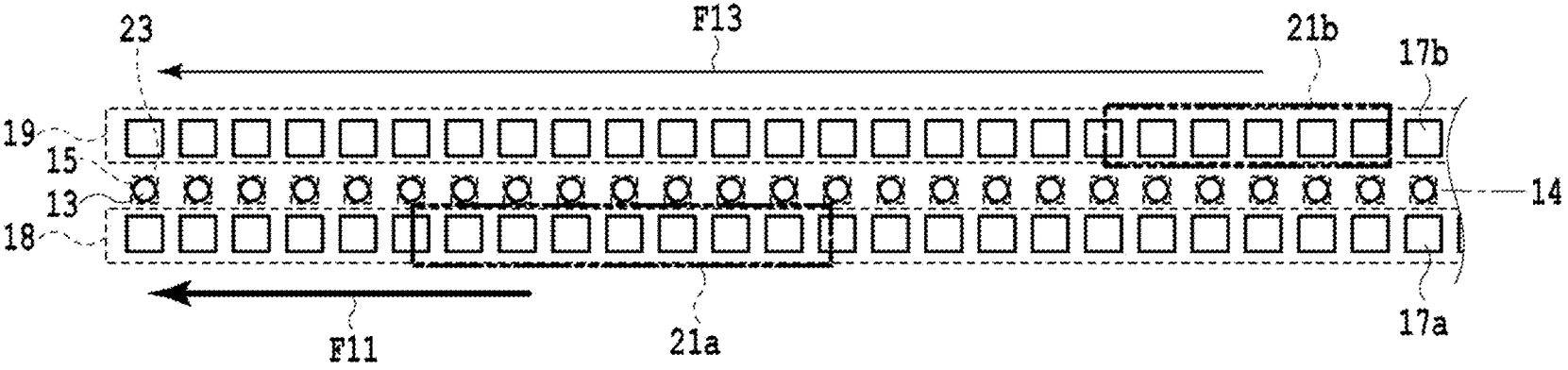

Next, the flow of liquid in the ejection opening array 14 for the case of ejecting liquid through a large number of ejection openings will be described with reference to FIGS. 8A and 8B. FIG. 8A is a diagram illustrating the flow of liquid in a comparative example to the present embodiment; FIG. 8B is a diagram illustrating the flow of liquid in a liquid ejection head 3 of the present embodiment.

In the case where liquid is ejected through a large number of ejection opening 13, in either of the present embodiment and the comparative example, liquid is supplied to the ejection opening array 14 from both the liquid supply port 21*a* or 22*a* and the liquid collection port 21*b* or 22*b*. For example, in the present embodiment illustrated in FIG. 8B, liquid is supplied from the liquid supply port 21*a* as indicated by the arrow F11 while liquid is also supplied from the liquid collection port 21*b* as indicated by the arrow F13. In the same way, also in the comparative example illustrated in FIG. 8A, liquid is supplied from the liquid supply port 22*a* as indicated by the arrow F10, and the liquid is supplied from the liquid collection port 22*b* as indicated by the arrow F20. Such liquid flows are caused because in the case where liquid is ejected through a large number of ejection openings 13, negative pressure increases in both the liquid-collection flow path from the pressure chamber 23 to the liquid collection port 21*b* or 22*b* and the liquid-supply flow path from the pressure chamber 23 to the liquid supply port 21*a* or 22*a*.

The liquid in the flow path on the collection side communicating with the liquid collection port 21*b* or 22*b* has been heated by the heat generating element, and the temperature of the liquid has relatively increased. Thus, in the case where liquid is ejected through a large number of ejection opening 13 simultaneously, and where liquid having an increased temperature flows into the print element substrate 100, the heat of the liquid increases also the temperature of the print element substrate 100. In particular, in the case of a liquid ejection head having liquid ejection units 300 in in-line arrangement, the temperature tends to increase at end portions of the print element substrate 100. The reason is as follows.

In the case of a liquid ejection head having liquid ejection units 300 in in-line arrangement, the distance between adjoining print element substrates 100 needs to be small. Specifically, the distance from an end portion in the X direction (first direction) of the print element substrate 100 to the end portions of the ejection opening arrays needs to be formed smaller than the distance from an end portion of the element substrate in a direction orthogonal to the X direction (second direction (Y direction)) to the ejection opening arrays. As a result, the area of the region a (see FIG. 6) formed between end portions of the ejection opening arrays 14 and the end portion of the print element substrate 100 is smaller than the areas of other end portion regions, and this makes it difficult for the heat generated in liquid ejection to dissipate from the region a.

In the case where the region a is small, the liquid supply port 21*a*1 located at an end portion in the X direction needs to be arranged to be closer to the center of the print element substrate 100 than the end portion of the ejection opening array 14 as illustrated in FIGS. 8A and 8B. This configuration makes longer the distance in the flow path from the liquid supply port 21*a* to the end portion of the ejection opening array 14 and the distance in the flow path and from the liquid collection port 21*b* to the end portion of the ejection opening array 14. As a result, the liquid flowing from the end portion of the liquid collection path 19 to the liquid collection port 21*b* or 22*b* tends to receive heat from the print element substrate 100. For this reason, in the comparative example for the case of ejecting liquid through a large number of ejection openings 13 simultaneously, the temperature around the end portion of the ejection opening array 14, in other words, the temperature at the end portion of the print element substrate 100 tends to be higher than the temperature of other portions.

Hence, in the present embodiment, of the multiple liquid supply ports 21*a*1, 21*a*2, and 21*a*3, the liquid supply ports 21*a*1 and 21*a*2 located at the end portions in the X direction have larger opening areas than the other liquid supply ports 21*a*3 and the liquid collection ports 21*b*. In this example, the lengths in the X direction of the liquid supply ports 21*a*1 and 21*a*2 are set larger than those of the other liquid supply port 21*a*3 and the liquid collection ports 21*b* to make the opening areas of the liquid supply ports 21*a*1 and 21*a*2 larger than those of the other ports.

Larger opening areas of the liquid supply ports 21*a*1 and 21*a*2, as described above, enable the amount of liquid flowing from the liquid supply ports 21*a*1 and 21*a*2 into the ejection opening array 14 to be larger than the amount of liquid flowing from the liquid supply port 21*a*3 and the liquid collection ports 21*b* into the ejection opening array 14. As a result, a large amount of liquid is supplied to the end portions of the print element substrate 100 from the liquid supply ports 21*a*1 and 21*a*2, decreasing the amount of liquid supplied from the liquid collection port 21*b*.

As described earlier, the temperature of the liquid on the liquid collection side has increased along with the circulation of the liquid, while the temperature of the liquid on the liquid supply side is relatively low. Thus, by increasing the amount of liquid with low temperature flowing in from the liquid supply ports 21*a* and decreasing the amount of liquid with high temperature flowing in from the liquid collection ports 21*b*, it is possible to reduce the increase in the temperature of the print element substrate 100. In particular, in the present embodiment, since the liquid supply ports 21*a* (21*a*1, 21*a*2) closer to the end portions of the print element substrate 100 are configured to have larger opening areas, it is possible to reduce the increase in the temperature at the end portions of the print element substrate 100. This in turn makes it possible to reduce the variation in the temperature distribution of the ejection opening array 14 of the print element substrate 100, improving the ejection characteristics, such as the liquid ejection speed and the amount of ejected liquid, of each ejection opening. Thus, the printing apparatus including the liquid ejection head according to the present embodiment improves the quality of printed images.

In contrast, in the liquid ejection head in the comparative example, the opening area of the liquid supply port 22*a* is equal to the opening area of the collection port. Accordingly, a relatively large amount of liquid is supplied from the liquid collection port 22*a*, and thus, the temperature of the print element substrate 100 tends to increase. In particular, the temperature of the liquid at the end portions of the print element substrate 100 tends to increase, and thus there is a possibility of causing the variation in the liquid ejection speed and the amount of ejected liquid at each ejection opening.

Figure 9A:
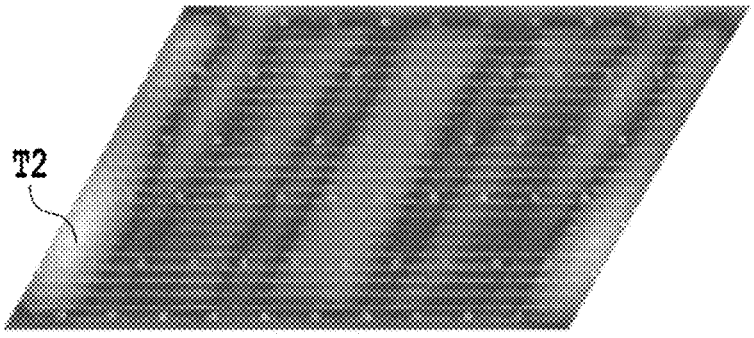
FIGS. 9A and 9B are diagrams showing the temperature distributions of print element substrates.
Figure 9B:
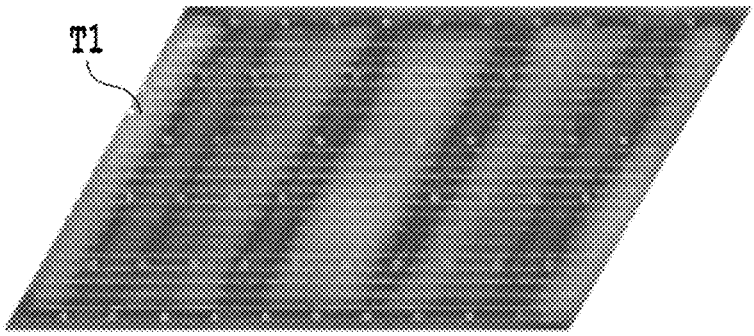

FIGS. 9A and 9B show the measurement results of temperature distribution of a print element substrate 100 in the present embodiment and a print element substrate 100 in a comparative example. FIG. 9A shows the measurement result of the comparative example; FIG. 9B shows the measurement result of the present embodiment. The parts indicated by high densities in FIGS. 9A and 9B show low-temperature portions. For the print element substrate 100 in the comparative example, temperature T2 at an end portion is 58° C., while for the print element substrate 100 in the present embodiment, temperature T1 at the end portion is decreased to approximately 54° C. As is apparent also from these results, the present embodiment decreases the temperature at the end portions of the print element substrate 100, compared to the comparative example.

OTHER EMBODIMENTS

Although in the above embodiment, of the multiple liquid supply ports 21*a*1, 21*a*2, and 21*a*3 arranged in the first direction (X direction), only the opening areas of the liquid supply ports 21*a*1 and 21*a*2 located at both end portions are formed to be larger than those of the liquid collection ports 21*b*, the present disclosure is not limited to this configuration. Specifically, of the multiple liquid supply ports, not only the opening areas of the liquid supply ports located at both end portions but also the opening area of the liquid supply port located at the intermediate position (the liquid supply port 21*a*3 in FIG. 3) may be larger than those of the liquid collection ports 21*b*. This configuration enables a larger amount of liquid to be supplied also to the intermediate portion of the print element substrate from the liquid supply side, enabling reduction of the increase in the temperature of the entire print element substrate. Note that the number and positions of liquid supply ports and liquid collection ports may be set according to the size of the print element substrate, and the number of ejection openings, and other factors, as appropriate, and hence, they are not limited to those disclosed in the above embodiment.

Figure 10A:
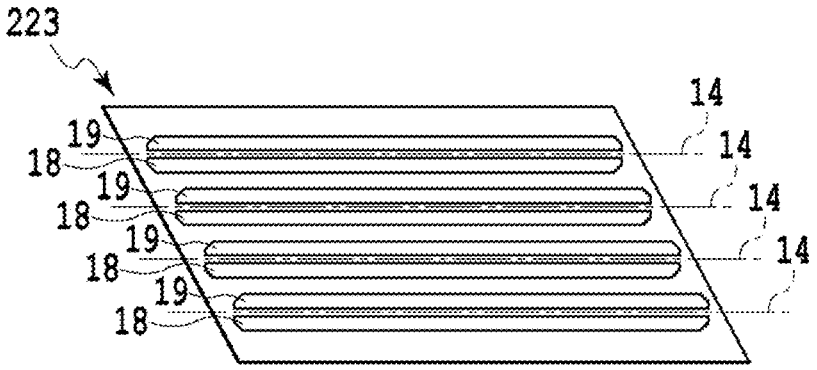
FIGS. 10A and 10B are diagrams illustrating another example of liquid supply paths and liquid collection paths formed in a liquid supply-path member.
Figure 10B:
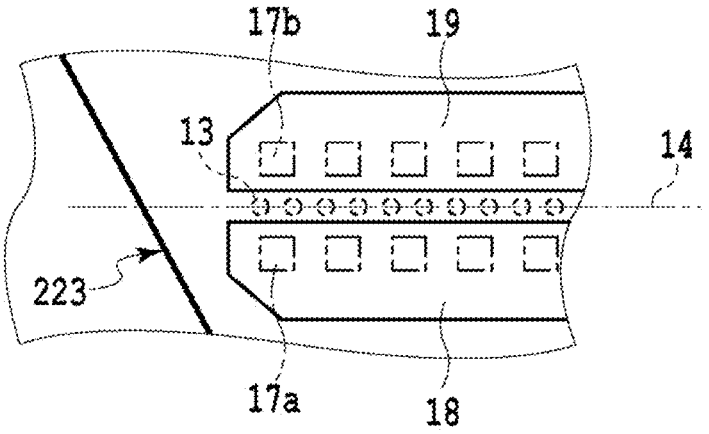

Although the above embodiment illustrates an example in which the liquid supply path 18 and the liquid collection path 19 formed in the liquid supply-path member 223 are in rectangular shapes, the liquid supply path 18 and the liquid collection path 19 are not limited to those having rectangular planar shapes. For example, the liquid supply path 18 and the liquid collection path 19 may be formed in hexagonal planar shapes as illustrated in FIGS. 10A and 10B. With this configuration, the position of an end portion of the liquid supply path 18 can be closer to the end portion of the print element substrate 100, and thereby, a greater number of ejection openings can be arranged accordingly. In the foregoing example illustrated in FIG. 3, each ejection opening 13 is associated with one individual supply path 17*a* and one individual collection path 17*b*. Alternatively, multiple ejection openings (two ejection openings in FIG. 7) may be associated with one individual supply path 17*a* and one individual collection path 17*b* as illustrated in FIG. 10B.

In addition, the planar shape of the liquid ejection unit 300 is not limited to a parallelogram but may be in another shape. For example, the planar shape of the liquid ejection unit 300 may be rectangular as illustrated in FIGS. 1A to 1C. In this case, to form a full-line liquid ejection head using multiple liquid ejection units 300, the distance between the end portions of adjoining liquid ejection units needs to be set according to the arrangement pitch of the ejection openings, and hence, the distance of the end portions of the liquid ejection units needs to be shorter. This makes the heat dissipation characteristics worse at the end portions of the liquid ejection units. However, also in this case, larger opening areas of the liquid supply ports than those of the liquid collection ports enable reduction of the increase in the temperature at the end portions of the print element substrate in the same way as in the above embodiment. This makes it possible to reduce the variation in the temperature distribution of the ejection opening array, providing favorable ejection characteristics across the entire ejection opening array.

Although the above embodiment illustrates an example in which the liquid ejection head and the liquid ejection apparatus according to the present disclosure are used for a printing apparatus that performs printing by ejecting liquid, the technique in the present disclosure is applicable to apparatuses other than printing apparatuses. For example, the liquid ejection head and the liquid ejection apparatus according to the present disclosure can be mounted as a print unit on copiers, fax machines having communication systems, word processors, and others. In addition, the liquid ejection head and the liquid ejection apparatus according to the present disclosure can also be applied to industrial apparatuses combined with various processing apparatuses. For example, the technique in the present disclosure is also applicable to biochip forming apparatuses and production apparatuses for three-dimensional structures such as electronic-circuit printing apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-085490 filed Apr. 26, 2019, which is hereby incorporated by reference herein in its entirety.

What is claimed is:

1. A liquid ejection head comprising an element substrate including an ejection opening array in which multiple ejection openings through which liquid is ejected are arranged along a first direction, multiple pressure chambers communicating with the respective ejection openings, heat generating elements capable of generating thermal energy for ejecting liquid, supplied to the pressure chambers, through the ejection openings, a first supply path extending in the first direction and communicating with the pressure chambers, a first collection path extending in the first direction and communicating with the pressure chambers, multiple liquid supply ports communicating with the first supply path at different positions along the first direction, and a liquid collection port communicating with the first collection path, wherein among the multiple liquid supply ports, at least a liquid supply port located at an end portion in the first direction has an opening area larger than the opening area of the liquid collection port.

2. The liquid ejection head according to claim 1, wherein the length in the first direction of the liquid supply port located at the end portion is larger than the length in the first direction of the liquid collection port.

3. The liquid ejection head according to claim 2, wherein the liquid supply port located at the end portion in the first direction has an opening area larger than the opening area of, among the multiple liquid supply ports, at least a liquid supply port located at an intermediate portion in the first direction.

4. The liquid ejection head according to claim 3, wherein each of the liquid collection ports has the same length in the first direction.

5. The liquid ejection head according to claim 1, wherein a plurality of the liquid collection ports are formed along the first direction.

6. The liquid ejection head according to claim 5, wherein each of the liquid collection ports has the same length in the first direction.

7. The liquid ejection head according to claim 1, wherein a plurality of element substrates are arranged to adjoin one another along the first direction, and an end portion in the first direction of each element substrate of the adjoining element substrates faces an end portion in the first direction of a next element substrate.

8. The liquid ejection head according to claim 1, wherein the distance from an end portion in the first direction of the element substrate to an end portion of the ejection opening array in the first direction is shorter than the distance from an end portion of the element substrate in a second direction orthogonal to the first direction to the ejection opening array.

9. The liquid ejection head according to claim 1, further comprising:

a flow-path unit joined to the element substrate, wherein the flow-path unit includes a second liquid supply path communicating with the liquid supply ports and a second liquid collection path communicating with the liquid collection port.

10. The liquid ejection head according to claim 9, wherein the flow-path unit includes a flow-path member joined to the element substrate and a support member supporting the flow-path member, and the flow-path member is formed of a heat resistant member.

11. A liquid ejection apparatus comprising:

the liquid ejection head according to claim 9; and a liquid supply unit that supplies liquid to the second liquid supply path and collects liquid from the second liquid collection path, wherein liquid is circulated between the liquid supply unit and the liquid ejection head.

12. A printing apparatus comprising:

the liquid ejection apparatus according to claim 11; and a conveyance unit that conveys a print medium onto which liquid ejected through the ejection openings of the liquid ejection head is landed.

13. The liquid ejection head according to claim 10, wherein a heat resistance R (K/W) of the flow-path member satisfies formula 1:

$$R \geq 1.4/\ln\{0.525e^{1.004P}-0.372\}^{-1} \quad \text{(formula 1)},$$

where P (μJ/pL) is thermal energy inputted to the liquid per unit volume by the heat generating elements in ejecting the liquid through the ejection openings.

14. A liquid ejection apparatus comprising:

the liquid ejection head according to claim 10; and a liquid supply unit that supplies liquid to the second liquid supply path and collects liquid from the second liquid collection path, wherein liquid is circulated between the liquid supply unit and the liquid ejection head.

15. A liquid ejection apparatus comprising:

the liquid ejection head according to claim 1; and a liquid supply unit that supplies liquid to the liquid supply ports and collects liquid supplied to the liquid ejection head from the liquid collection port, wherein liquid is circulated between the liquid supply unit and the liquid ejection head.

16. A printing apparatus comprising:

the liquid ejection apparatus according to claim 15; and a conveyance unit that conveys a print medium onto which liquid ejected through the ejection openings of the liquid ejection head is landed.

* * * * *